United States Patent [19]

Singer et al.

[11] 4,337,018

[45] Jun. 29, 1982

[54] ROTARY IMPELLER PUMP OR MOTOR WITH COUNTERBALANCING CHAMBER IN THRUST PLATE BEARING COUNTERBORE

[75] Inventors: Carl M. Singer, New Castle, Pa.; Mateiu J. Oana; John D. Turko, both of Youngstown, Ohio

[73] Assignee: Commercial Shearing, Inc., Youngstown, Ohio

[21] Appl. No.: 116,636

[22] Filed: Jan. 29, 1980

[51] Int. Cl.[3] ..... F03C 2/08; F04C 2/18; F04C 15/00

[52] U.S. Cl. ..... 418/132

[58] Field of Search ..... 418/131-135

[56] References Cited

U.S. PATENT DOCUMENTS

| | | | |
|---|---|---|---|
| 2,870,720 | 1/1959 | Lorenz | 418/132 |
| 3,063,378 | 11/1962 | Hart | 418/131 |
| 3,309,997 | 3/1967 | Kita | 418/132 |
| 3,313,238 | 4/1967 | Muller et al. | 418/131 |
| 3,481,275 | 12/1969 | Gelin | 418/133 |
| 3,778,200 | 12/1973 | Wellman | 418/132 |

*Primary Examiner*—John J. Vrablik

*Attorney, Agent, or Firm*—Buell, Blenko, Ziesenheim & Beck

[57] ABSTRACT

A rotary impeller pump or motor is provided having a case, a pair of rotary impellers in said case, a plate having a first face divided by lands into a plurality of chambers against corresponding ends of the impellers and a second face having two counterbores around the rotary impellers, annular seal means intermediate the ends of each counterbore forming a pair of chambers within the counterbore, opposed inlet and outlet ports in said case whereby said plate is balanced in pressure on opposite sides by fluid in said chambers on the first face and the counterbores.

10 Claims, 7 Drawing Figures

ROTARY IMPELLER PUMP OR MOTOR WITH COUNTERBALANCING CHAMBER IN THRUST PLATE BEARING COUNTERBORE

This invention relates to rotary pumps and motors and particularly to pumps and motors with rotary impellers and to means for sealing the ends of said impellers.

Rotary pumps and motors such as for example gear pumps, have a pair of impellers in the form of meshing gears and a case extending closely around a portion of the periphery of each impeller to cooperate with the impeller teeth in trapping fluid on the low pressure side of the pump and carrying it to the high pressure side of the pump. The meshed teeth prevent any substantial return flow between the impellers as a result of the pressure differential between the outlet and inlet sides of the pump. End plates are provided to limit the return flow between the ends of the impellers, which are rotating, and the case. A major problem in such pumps and motors is that of adjusting the end plates so that they are tight enough to prevent any substantial return flow and yet loose enough to prevent the impellers from being seized and stopped. Since the impellers are generally made of steel and the end plates are made of bronze there is further complication that the bronze expands at a higher rate than the steel with increases in temperature so that the end plates must be smaller in diameter than the case to compensate for this. Finally, the enclosed end plates are preferably arranged to "float" relative to the impeller ends, with the face of the plate opposite the impeller being subject to pressure of fluid from the outlet side of the pump for the purpose of creating a balancing pressure urging the plate against the impeller ends to create the desired seal. This produces a very real problem created by the fact that the fluid pressures on the faces of the plate adjacent the impeller differ greatly from the outlet side to the inlet side which results in an unbalance pressure and in some cases seizure of the impeller and plate. These problems have long been recognized in the art and are discussed in Patton U.S. Pat. No. 1,972,632 and Kane U.S. Pat. No. 2,714,856, both of which patents offer solutions to these problems, which under proper circumstances have worked well and efficiently. However, modern technology has required that pumps and motors be operated at higher and higher pressures which have aggravated the problems to the point where prior art solutions are no longer applicable.

We have invented a new form of rotary pump and motor construction which eliminates these problems even at very high pressures. We provide novel end plates for engaging the ends of the rotary impellers, which impellers provide a degree of uniform balancing of pressure heretofore impossible in rotary motors and pumps. The end plates are symmetrical and thus permit reversal of flow through the pump or motor. In view of the improved balancing action, the life of the end plates is markedly improved along with the efficiency of the pump.

Preferably, we provide a rotary pump and motor comprising a rotary impeller, a thrust plate against an end of the rotary impeller and a case enclosing the plate and impeller with a portion of the case fitting closely around a portion of the impeller to trap fluid therebetween shaft members at each end of said impeller concentric therewith and extending into bearing members in said case, an opening in said thrust plate receiving said shaft member, diametrically opposed outlet and inlet ports in said case, the periphery of the thrust plate extending substantially in contact with the case generally around its periphery, at least one notch in the periphery of the plate adjacent each of the outlet and inlet ports, at least one notch in the periphery of the plate spaced intermediate the notches at the inlet and outlet ports, said notches providing communication from one side of the plate to the other, a valley portion on the face of said plate at each notch, a land between each of the valley portions bearing against the impeller to sealingly separate said valley portions and notches, said lands being of such size as to provide a one tooth seal between each of the adjacent valley portions, an annular seal in the opening in said thrust plate receiving said shaft member intermediate the ends of said opening and forming with the bearing means two separate chambers, and a passage communicating from the notch intermediate the ports to a chamber formed by said annular seal, the impeller and bearing means. Preferably, the pump or motor has a pair of rotary impellers and the plates are in the form of a figure 8 with the impeller axes generally concentric with the circular openings in the figure 8. Preferably, the plate has a valley extending across the opposite ends of the figure 8 on the face which bears on the impellers and spaced from the circular openings by a land, and a pair of valleys, one on each side of a centerline through the figure 8 and spaced from the circular openings and from each other by a land. The valleys are pressurized by fluid from the pump interior, the two valleys at the inlet and outlet ports are pressurized by fluid at each of those ports whereas the valleys at the opposite ends are pressurized by fluid under pressure from the impeller. These fluid forces produce counter forces between the impellers and plate which reduces the wear on both the gears and plates, increases the permissible speed of operation and the permissible pressure and reduces the heating of the fluid. The chamber formed between the sealing member, the wall of the opening in the thrust plate, the impeller and the bearing means receives high pressure fluid through the passage from the intermediate notch so as to form a balancing pressure between the impeller and thrust plate which acts to counterbalance the pressure in the other chamber formed by the sealing member which acts between the case and thrust plate.

In the foregoing general description, we have set out certain objects, advantages and purposes of the invention. Other objects, purposes and advantages will be apparent from a consideration of the following description and the accompanying drawings in which.

Figure 1:
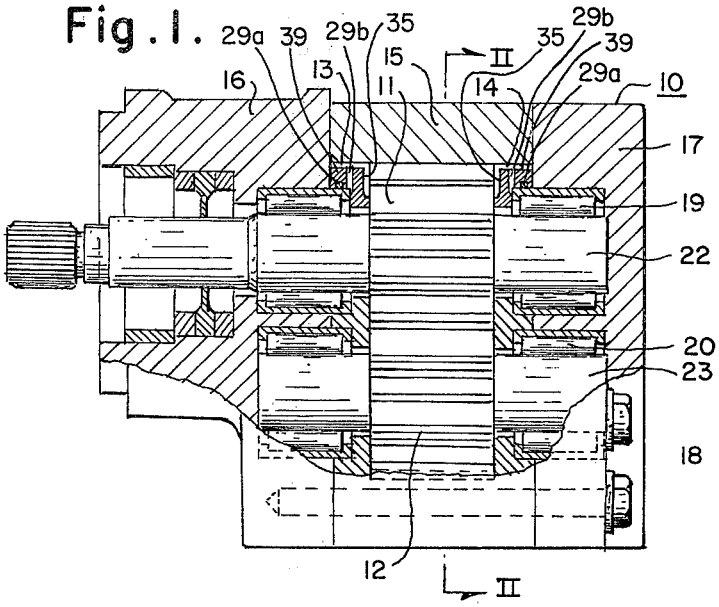
FIG. 1 is a sectional view of a rotary pump and motor taken through the impeller axes.

Referring to the drawings, we have illustrated a gear pump 10, which is also usable as a motor, having a pair of meshing gear impellers 11 and 12 between a pair of end thrust plates 13 and 14 with a central casing member 15 enclosing the outer peripheries of the impellers and plates. Ports 15*a* and 15*b* through the casing member 15 serve interchangeably as inlet and outlet ports for the pump. The thrust plates 13 and 14 and casing member 15 are enclosed between a pair of end casing members 16 and 17, and bolts 18 extend through casing members 15 and 17 and threadingly screw into casing member 16 to hold the casing members together in tightly sealed relation. The inner side of the casing member 17 lies in a continuous flat plane except for a pair of cylindrical depressions into which bearings 19 and 20 are fitted. Hollow cylindrical hubs 22 and 23 are supported in bearings 19 and 20.

Figure 3:
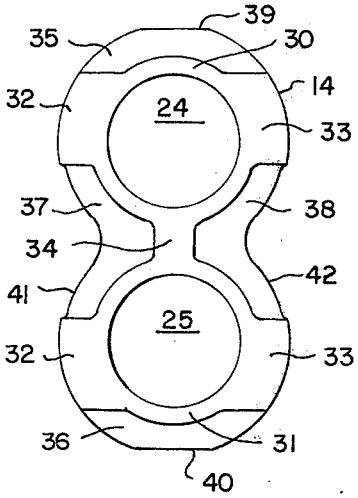
FIG. 3 is a view of an end plate showing its front face which engages the impeller ends.
Figure 2:
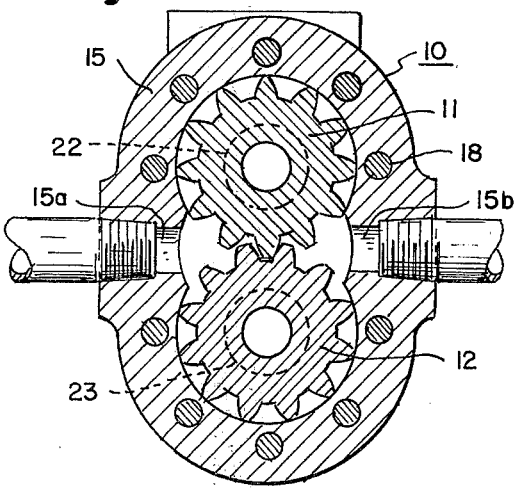
FIG. 2 is a sectional view on the line II—II of FIG. 1.
Figure 4:
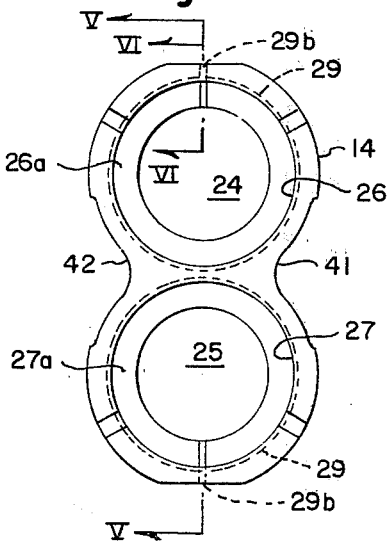
FIG. 4 is a view of the rear face of the thrust plate of FIG. 3.
Figure 5:
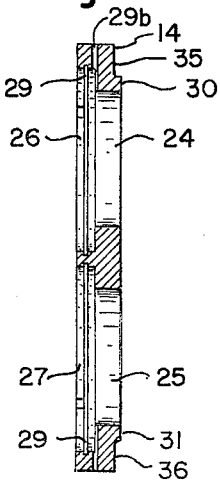
FIG. 5 is a sectional view of the thrust plate taken on the line V—V of FIG. 4.
Figure 6:
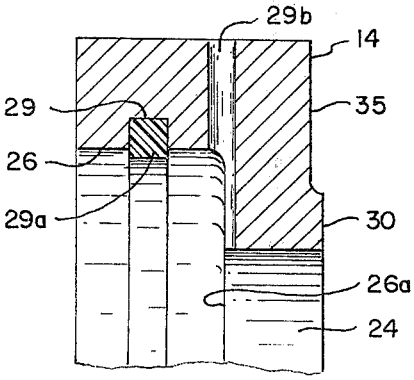
FIG. 6 is a fragmentary section on the line VI—VI of FIG. 4.

Thrust plate 14, which is identical with thrust plate 13, will be described in detail. Thrust plate 14 has a pair of openings 24 and 25 through which hubs 22 and 23 extend, and these openings are countersunk on the rear face of the plate to provide counterbores 26 and 27 fitting closely around the projecting ends of the bearing shells 19 and 20 (FIG. 1). The front face of thrust plate 14, illustrated in FIG. 3, is in the form of a figure 8 having an annular land 30 and 31, surrounding each of openings 24 and 25 connected to opposed radial lands 32 and 33 and transverse land 34 extending between lands 30 and 31. The portion between the lands 30, 31,32, 33 and 34 is recessed to form chambers 35 and 36 at opposite ends of plate 14 and chambers 37 and 38 at the inlet and outlet sides of plate 14. These chambers 35, 36, 37 and 38 are of quite shallow depth and provide pressure chambers on the face of the plate 14. Notches 39 and 40 at opposite ends of plate 14 communicate from chambers 35 and 36 through the periphery of plate 14 to the rear side of the plate. Notches 41 and 42 at the inlet and outlet sides of the periphery communicate from chambers 37 and 38 to the rear side of plate 14. The rear face of plate 14, illustrated in FIG. 4, is, of course, likewise in the form of a figure 8 with flat surfaces paralleling the adjacent flat surface of casing member 17 and with the counterbores 26 and 27 above mentioned. Each of counterbores 26 and 27 is provided with an annular groove 29 intermediate the ends of the counterbore carrying an annular seal ring 29*a*. The ring 29*a* may be of reinforced Teflon or similar material. A passage 29*b* extends from each of notches 39 and 40 into the area between seal ring 29*a* and the bottom 26*a* and 27*a* of each counterbore 26 and 27.

In operation, the high pressure fluid in the outlet side causes a slight shift of the thrust plates 13 and 14 and impellers 11 and 12 toward the low pressure side. This permits high pressure fluid through the slight clearance around the periphery of the thrust plates and impellers to reach passages 29*b* which then pressurizes the chamber formed by the seal ring 29*a*, the walls of counterbores 26 and 27, the bearing means and the face of the impeller bearing against the thrust plate and provides a counterbalancing force against the forces urging the thrust plate from the rear toward the impeller and reduces the wear which otherwise occurs in high pressure operation while maintaining the face of the plate in substantial sealing arrangement against the ends of the impellers.

Figure 7:
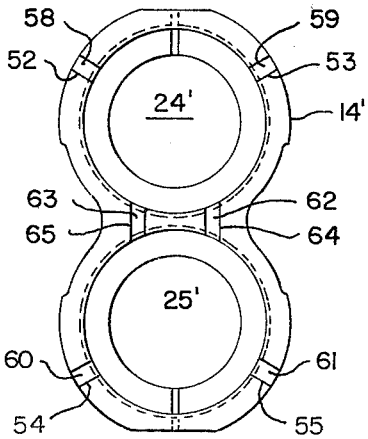
FIG. 7 is a view of the rear face of a second embodiment of thrust plate according to this invention.

In the embodiment illustrated in FIG. 7, like elements are given like numbers to those of FIGS. 1 to 6 with a prime sign. In this embodiment, the rear face of plate 14' is provided with a pair of spaced channels 52, 53, 54, 55, 64 and 65 divide the semicircular outer ends of the figure 8 from its central portion and receive elastomer seal members 58, 59, 60, 61, 62 and 63 which separate the outer ends from the central portion into separate pockets or chambers. Each of the seals is as long as the corresponding channel and extends slightly above the top of the channel to seal against the surface of casing 17.

The periphery of plate 14 is notched at each end with notches 39 and 40 as mentioned above, which extend the full width of the plate. The notches serve two functions; they permit communication from one side to the other of plate 14 and they prevent buckling of the plate from heating during operation.

Plate 13 corresponds identically with plate 14 in construction, mounting and operation as does also plate 13' and 14' and will not be described in detail. The end casing member 16 cooperates with plate 13 in the same manner as the opposite end casing 17 cooperates with plate 14.

In operation, the chambers 35 and 36 and the area between channels 52 and 53 at one end and channels 54 and 55 at the other end are pressurized by fluid between the casing and the impeller so that the plate ends are fully balanced. Similarly, the chamber 37 on the front and the area defined by channels 52, 54, 65 on the rear are subject to the inlet pressure and chamber 38 on the front and the area defined by channels 53, 55, 64 are subject to the outlet pressure, thus balancing plates 13 and 14 in sealing relation between casing members 16 and 17 and impellers 11 and 12.

In the foregoing specification we have set out certain preferred embodiments of out invention; however, the invention may be otherwise embodied within the scope of the following claims.

We claim:

1. A pressure plate for corresponding ends of a pair of cooperating impellers in a rotary pump or motor comprising a metal body having a first face adapted to abut the impeller ends, a pair of openings to receive impeller shafts and a second face generally parallel to said first face, a plurality of chambers in said first face defined by radial lands on the first face bearing against the impellers to restrict flow across said first face, said lands being of such size as to provide a one tooth seal with the impellers between adjacent chambers of said plurality of chambers, a counterbore in each opening of said pair of openings at said second face, an annular seal in each counterbore intermediate the ends thereof and forming two separate chambers therein when bearing means are assembled in each counterbore and passage means communicating between the periphery of the thrust plate at opposite ends and one of said chambers in each counterbore.

2. A pressure plate for rotary motors and pump as claimed in claim 1 wherein the annular seals are Teflon members carried in annular channels in the counterbore.

3. A pressure plate as claimed in claims 1 and 2 in the general form of a figure 8.

4. A pressure plate as claimed in claim 2 wherein the chambers in said first face are recessed in said face.

5. A pressure plate as claimed in claim 2 having notches in the periphery of the plate at the diametric opposite ends and at the diametric opposite sides communicating between said first and second face, said passage means communicating from said notches to one of said chambers in the counterbore.

6. A pressure plate as claimed in claim 2 having a plurality of spaced radial channels extending between said openings and the periphery of the thrust plate on the second face and elastomer sealing means therein.

7. A rotary impeller pump or motor comprising a pair of rotary impellers, a thrust plate having a first face against corresponding ends of the impellers, a case having a first section enclosing the impellers and the periphery of the plate and having a second section enclosing a second face of the plate opposite the impeller, means detachably securing the two sections of case together, diametrically opposed inlet and outlet ports in said case, the first section having semicircular portions in close fitting engagement with the impellers to trap fluid therebetween and in contact with adjacent portions of the plate periphery, shaft members at each end of each of said impellers concentric therewith, said thrust plate being shiftable in the case axially against the impellers and having a pair of openings therethrough concentric with the shaft members and being counterbored at said openings from the second face of the plate, bearing means carrying the impellers and having a nonrotating outer periphery secured in the second section of the case and extending into said counterbored portions, at least one notch in the periphery of said thrust plate adjacent each of the inlet and outlet ports, at least one notch in the periphery of the thrust plate at each end intermediate the notches at the inlet and outlet ports, a plurality of chambers formed on the first face of said plate adjacent the impellers defined by radial lands on the first face bearing against the impellers, said lands being of such size as to provide a one tooth seal with the impeller between each of the adjacent chambers, an annular seal in each counterbore intermediate the ends thereof and forming two separate chambers therein and passage means communicating between one of said chambers in each counterbore and the adjacent intermediate notch.

8. A rotary impeller pump or motor as claimed in claim 7 wherein the annular seals are carried in annular channels in the counterbores intermediate the ends of said counterbore.

9. A rotary impeller pump or motor as claimed in claims 7 or 8 wherein the chambers in said first face are recessed in said face.

10. A rotary impeller pump or motor as claimed in claims 7 or 8 having opposed inlet and outlet ports in said case on opposite sides of said impellers, a chamber on each of the first and second faces of the plated adjacent each of the inlet and the outlet ports and a chamber on each of the first and second faces of the plate end adjacent the portion of the case and impellers in which fluid is trapped.

* * * * *

UNITED STATES PATENT AND TRADEMARK OFFICE

CERTIFICATE OF CORRECTION

PATENT NO. : 4,337,018

DATED : June 29, 1982

INVENTOR(S) : CARL M. SINGER, MATEIU J. OANA and JOHN D. TURKO

It is certified that error appears in the above-identified patent and that said Letters Patent are hereby corrected as shown below:

Column 4, line 32, "out" should read --our--.

Claim 10, column 6, line 22, "plated" should be --plate--.

Signed and Sealed this

*Seventh* Day of *September 1982*

[SEAL]

*Attest:*

GERALD J. MOSSINGHOFF

*Attesting Officer*

*Commissioner of Patents and Trademarks*